US007886411B2

(12) United States Patent
Jezzi

(10) Patent No.: US 7,886,411 B2
(45) Date of Patent: Feb. 15, 2011

(54) APPARATUS FOR THE UNIFORM DISTRIBUTION OF FIBERS IN AN AIR STREAM

(76) Inventor: Arrigo D. Jezzi, 169 Upland Ter., Bala Cynwyd, PA (US) 19004

( * ) Notice: Subject to any disclaimer, the term of this patent is extended or adjusted under 35 U.S.C. 154(b) by 56 days.

(21) Appl. No.: 12/455,201

(22) Filed: May 30, 2009

(65) Prior Publication Data

US 2009/0241831 A1 Oct. 1, 2009

Related U.S. Application Data

(63) Continuation-in-part of application No. 11/825,331, filed on Jul. 6, 2007, now abandoned.

(51) Int. Cl.
*D01G 25/00* (2006.01)

(52) U.S. Cl. ..... 19/66 R; 19/304

(58) Field of Classification Search ..... 19/65 R, 19/66 R, 304
See application file for complete search history.

(56) References Cited

U.S. PATENT DOCUMENTS

| | | | | |
|---|---|---|---|---|
| 2,447,161 | A | | 8/1948 | Coghil |
| 2,748,429 | A | | 5/1956 | Clark |
| 2,751,633 | A | | 6/1956 | Clark |
| 2,810,940 | A | | 10/1957 | Mills |
| 2,931,076 | A | | 3/1960 | Clark |
| 3,575,749 | A | | 4/1971 | Kroyer |
| 3,581,706 | A | | 6/1971 | Rasmussen |
| 3,669,778 | A | | 6/1972 | Rasmussen |
| 3,692,622 | A | | 9/1972 | Dunning |
| 3,733,234 | A | | 5/1973 | Dunnning |
| 3,764,451 | A | | 10/1973 | Dunning |
| 3,769,115 | A | | 10/1973 | Rasmussen |
| 3,776,807 | A | | 12/1973 | Dunning |
| 3,812,553 | A | * | 5/1974 | Marshall et al. ..... 19/302 |
| 3,825,381 | A | | 7/1974 | Dunning |
| 3,862,867 | A | | 1/1975 | Marshall |
| 3,976,412 | A | | 8/1976 | Attwood |
| 3,982,302 | A | | 9/1976 | Vaalburg |
| 3,984,898 | A | | 10/1976 | Matsumura |
| 4,004,323 | A | | 1/1977 | Gotchell |
| 4,014,635 | A | | 3/1977 | Kroyer |
| 4,060,360 | A | | 11/1977 | Tapp |
| 4,074,393 | A | | 2/1978 | Hicklin |
| 4,100,324 | A | | 7/1978 | Anderson |
| 4,160,059 | A | | 7/1979 | Samejima |
| 4,264,290 | A | | 4/1981 | Dunkerly |
| 4,269,578 | A | | 5/1981 | Gustavsson |
| 4,285,647 | A | | 8/1981 | Dunkerly |
| 4,352,649 | A | | 10/1982 | Jacobsen |
| 4,366,111 | A | | 12/1982 | Dinius |
| 4,375,448 | A | | 3/1983 | Appel |
| 4,494,278 | A | | 1/1985 | Kroyer |
| 4,551,191 | A | | 11/1985 | Kock |
| 4,640,810 | A | | 2/1987 | Laursen |

(Continued)

*Primary Examiner*—Shaun R Hurley
(74) *Attorney, Agent, or Firm*—Thomas J. Connelly; Wilhelm Law, S.C.

(57) ABSTRACT

An apparatus for the manufacture of an air laid web in which individual cellulose fibers or textile fibers or their blends can be conveyed and distributed by air uniformly to any desired width onto a forming zone composed of either a foraminous screen or a fibrous polymer matrix on top of a consolidating vacuum box.

20 Claims, 6 Drawing Sheets

U.S. PATENT DOCUMENTS 4,688,301 A * 8/1987 Thorbjornsson et al. ..... 19/296
4,701,294 A 10/1987 Radwanski
4,749,423 A 6/1988 Vaalburg
4,767,586 A 8/1988 Radwanski
5,471,712 A 12/1995 Kroyer
5,885,516 A 3/1999 Christensen
6,033,199 A 3/2000 Vanderhaar
7,107,652 B2 9/2006 Thordahl
2006/0174452 A1 8/2006 Celli

* cited by examiner

APPARATUS FOR THE UNIFORM DISTRIBUTION OF FIBERS IN AN AIR STREAM

CROSS REFERENCE TO RELATED APPLICATION(S)

This is a continuation-in-part application of Ser. No. 11/825,331, filed Jul. 6, 2007, now abandoned.

TECHNICAL FIELD OF INVENTION

This invention relates to an apparatus which will uniformly distribute individually defibrated cellulose fibers, individual textile staple fibers, or a blend thereof, so that they can be formed into a substrate or web or incorporated into another non-woven web of fibers.

BACKGROUND OF THE INVENTION

Historically, many attempts have been made at developing and commercializing apparatus for the formation and uniform distribution of air laid fibers, be it staple textile fibers or cellulose pulp fibers.

All of these apparatus have been cumbersome, highly complex mechanical devices which have had several disadvantages in their operations. Several of these devices have actually been commercialized for the formation of fibrous webs or substrates in the non-woven industry.

Air forming of wood pulp fibrous webs has been carried out for many years; however, the resulting webs have been used for applications where either little strength is required, such as for absorbent products—i.e., pads—or applications where a certain minimum strength is required but the tactile and absorbency properties are unimportant—i.e., various specialty papers. U.S. Pat. No. 2,447,161 to Coghill, U.S. Pat. No. 2,810,940 to Mills, and British Pat. No. 1,088,991 illustrate various air-forming techniques for such applications.

In the late 1940's and early 1950's, work by James D'A. Clark resulted in the issuance of a series of patents directed to systems employing rotor blades mounted within a cylindrical fiber "disintegrating and dispersing chamber" wherein air-suspended fibers were fed to the chamber and discharged from the chamber through a screen onto a forming wire—viz., J. D'A. Clark U.S. Pat. Nos. 2,748,429, 2,751,633 and 2,931,076. However, Clark and his associates encountered serious problems with these types of forming systems as a result of disintegration of the fibers by mechanical co-action of the rotor blades with the chamber wall and/or the screen mounted therein which caused fibers to be "rolled and formed into balls or rice which resist separation"—a phenomenon more commonly referred to today as "pilling". Additionally, J. D'A. Clark encountered problems producing a web having a uniform cross-direction profile, because the fiber input and fiber path through the rotary former was not devoid of cross flow forces.

The formation of non-woven webs emanate from the textile industry as a result of taking a very old process such as carding, and combing the textile fibers into a wide web of loose fibers after which they are bonded either chemically or thermally into a consolidated substrate or web. The distribution of these fibers is done mechanically through a series of combing steps in which saw toothed clothed rolls work the fibers into individual strands from clumps and spreads them in the process to form a web. These types of processes lend themselves primarily to textile staple fibers that have fiber lengths of 1 to 2 inches. Even though further evolution of this process has led to the use of air to assist the doffing of the fibers off the main cylinder and in forming a web, these processes do not lend themselves well to short cellulosic fibers which are typically in the 2 to 3 mm in length.

In the mid nineteen sixties and seventies, a combination air and mechanical carding process took the technology further by taking combinations of short cellulosic fibers and longer textile staple fibers combining them mechanically and then air conveying them into a forming chamber so that they could be made into a substrate or web. U.S. Pat. Nos. 3,982,302 and 4,004,323 belonging to Scott Paper describe this process.

The disadvantage of this process was the fact that it was limited to the amount of short cellulose fibers that it could handle. The longer textile staple fibers were still needed to provide an adequate entanglement and fibrous matt structure that would allow to be combed or picked into an air stream for forming.

Both of the carding based processes described so far are depending on the basis weight cross direction profiles of the fibrous matt leading to the forming device. These cross direction profiles are developed and formed prior to the forming step and are somewhat fixed. So if they are not adequate there are no means of correcting of adjusting for them during the formation process. What these forming devices see in cross direction basis weight profile, the substrate or web will get as a result.

A second type of system for forming air-laid webs of dry cellulosic fibers which has found limited commercial use has been developed by Karl Kristian Kobs Kroyer and his associates as a result of work performed in Denmark. Certain of these systems are described in: Kroyer U.S. Pat. Nos. 3,575,749, 4,494,278, 4,014,635 and 5,471,712; Rasmussen U.S. Pat. Nos. 3,581,706 and 3,669,778; Rasmussen et al. U.S. Pat. No. 3,769,115; Attwood et al. U.S. Pat. No. 3,976,412; Tapp U.S. Pat. No. 4,060,360; and, Hicklin et al U.S. Pat. No. 4,074,393.

Hicklin U.S. Pat. No. 4,074,393 shows a funnel like device as the inlet method for the air conveyed fiber to the distributor device which comprises the forming head for this air forming apparatus. It is quite obvious from the construction of the entire forming head, which applies the "fiber sifting" technique for obtaining fiber uniformity in the traverse direction, that the inlet funnel that is used lacks the design features to operate solely as the forming head. The forming device which would ultimately convey the fibers to the forming zone is not this funnel, but the distributor with its multiple rotors. Nowhere in the specification are the details of the design of this funnel like inlet described, as it is quite obvious that they are not key to the overall performance of the forming head described by this invention.

The type of fiber sifting equipment described in the Kroyer patents suffers from poor productivity especially when making light weight webs. For example, the rotor action concentrates most of the incoming material at the periphery of the blades where the velocity is at a maximum. Most of the sifting action is believed to take place in these peripheral areas, while other regions of the sifting screen are either covered with more slowly moving material or are bare. Thus, a large percentage of the sifting screen area is poorly utilized and the system productivity is low. Moreover, fibers and agglomerates tend to remain in the forming head for extended periods of time, especially in the lower velocity, inner regions beneath the rotor blades. This accentuates the tendency of fibers to roll up into pills.

In an effort to overcome the productivity problem of such systems, complex production systems have been devised utilizing multiple forming heads—for example, up to eight separate spaced forming heads associated with multiple hammermills and each employing two or three side-by-side rotors. The most recent sifting type systems employing on the order of eighteen, twenty or more rotors per forming head, still require up to three separate forming heads in order to operate at satisfactory production speeds—that is, the systems employ up to fifty-four to sixty, or more, separate rotors with all of the attendant complex drive systems, feed arrangements, recycling equipment and hammermill equipment.

Honshu, U.S. Pat. Nos. 3,984,898 and 4,160,059, at approximately the same time developed a different concept to the above by combining the fiberization or defibration step into one single step. In this manner the cross direction of the web was dependent on the pulp lap cross-direction profiles feeding the defibrator. The function of the air stream was only to convey the individual fibers onto the foraminous screen to form the web. This process had several disadvantages, as the air stream employed for web forming could not be properly psychometrically conditioned, impacting the quality of the web due to static clumping as a result of very dry fluff fibers.

During the 1970's a series of patents were issued to C. E. Dunning and his associates which have been assigned Kimberly-Clark; such patents describing yet another approach to the formation of air-laid dry fiber webs. Such patents include: Dunning U.S. Pat. Nos. 3,692,622, 3,733,234 and 3,764,451; and, Dunning et al. U.S. Pat. Nos. 3,776,807 and 3,825,381. However, this system requires preparation of pre-formed rolls of fibers having high cross-directional uniformity and is not suitable for use with bulk or baled fibrous materials, such that, to date, the system has not found a commercial application.

Kimberly Clark also developed another fiber air forming process that is described in their U.S. Pat. No. 4,100,324 in which defibrated cellulose pulp is air formed into a molten microfiber meltblown polypropylene stream to form an air laid web without the use of chemical binders. The process described uses the defibrator as the method of conveying the fibers in an air stream into the polypropylene matrix. It is handicapped by the fact that it is a combination defibrator and air former which does neither function well. It is a highly mechanical device which limits the width of the machine based on the width of the defibrator which must span the entire width of the former. The critical speed of the defibrating rotor is the limiter on web forming width limiting it to below two meters typically.

Celli in US Application 20060174452, a few decades later took the same concept as the Kroyer distributor, but re-designed the geometry of the rotors. Rather than having the rotors rotate in the cross direction with their blades parallel to the distributor screens and creating a cross machine direction race track fiber flow inside the distributor, these rotors being cylindrical and rotating in the machine direction with parallel axes, perpendicular to the flow and equipped with radial elements in the form of needles or rods.

Dan Web in U.S. Pat. Nos. 4,278,113, 4,352,649, 4,640,810, 5,885,516 and 7,107,652 in an attempt to differentiate themselves from the Kroyer distributors in which they claimed parallel interfaces between the distributor screen geometries and the foraminous forming screen, developed a similar concept distributor but in a round drum-shaped geometry. This former head, where a fiber material mixed with air is conducted to at least one rotating perforated drum in a former head by injection, has internally fluidizing means constituted by air nozzles arranged longitudinally of the drum with the air being controlled longitudinally. Again, in this case the cross direction distribution of fibers is accomplished by the trajectory of the fibers inside the rotating drum formers, and the air system's primary purpose is only to convey the fibers to the forming screen.

Other devices have been developed in an attempt to spread fibers and or particles uniformly across the width of various forming zones. These apparatus may at first hand appear similar in nature and principle to the invention disclosed but at close scrutiny do not have the same design characteristics and would not work with the degree of efficiency as the professed invention. They also would suffer severely from great width capability limitations.

Marshall, U.S. Pat. No. 3,863,867, discusses a funnel like apparatus that is primarily designed to randomize the machine and cross direction formation of textile fibers of 1-2 inches in length through centrifugal force. This type of device uses diffusion of air flows as a primary means of fiber control and submits the fiber and air stream to areas of increased and reduced air velocities inside the apparatus which would result in turbulence and impact the cross-direction uniformity of the fibers. These techniques would not work at all in distributing the fibers to the forming section with short cellulose fibers which are the primary component of our fiber stream as the turbulence in the air stream would not provide the uniform distribution required in the cross direction.

Thorbjörnsson, U.S. Pat. No. 4,688,301, and Gustavsson, U.S. Pat. No. 4,269,578 also use a funnel like apparatus to distribute fibers from an inlet duct to a wider forming chamber. In both cases, they use either a mechanically oscillating device or an air pulsing device to spread the fibers evenly in the cross direction. Even though these types of devices have been used successfully in the textile industry with staple fibers, the speed of fiber distribution inside the spreading device will not be able to keep up with the throughput requirements of the forming device for high speed short fiber airlaid non-woven forming processes.

Kock, U.S. Pat. No. 4,551,191, another funnel like device was developed to handle particulate and not fibrous matter. It is composed of three segments involving 30 degree stepped angle changes in which the air velocity is increased, and with the three straight sections utilizing a riffling surface to spread the particles. This type of device, as it was primarily intended for particles, will create pilling as described earlier through the use of the riffling surfaces. Also, the device requires a change in direction as one of the means of spreading, which for light weight fibers will provide sufficient turbulence to affect the cross direction profile of the light weight fibers negatively.

Indeed, heretofore it is not believed that any of the previous air-forming techniques can be advantageously used in high speed production operations to prepare cellulose fiber sheet material that are sufficiently thin, and have adequate cross-directional profiles at high forming speeds to satisfy the performance requirements of the final product application.

BRIEF SUMMARY OF INVENTION

This invention is for a device to air lay cellulose, textile staple fibers and blends thereof by taking these fibers from an air transported duct and spreading these fibers to the full width of the forming zone in a uniform manner so that they can be air laid to form a consolidated fibrous web. This forming head is aerodynamically designed and has no moving parts making it an elegantly simple and effective forming head compared to prior art.

DETAILED DESCRIPTION OF THE INVENTION

Figure 1:
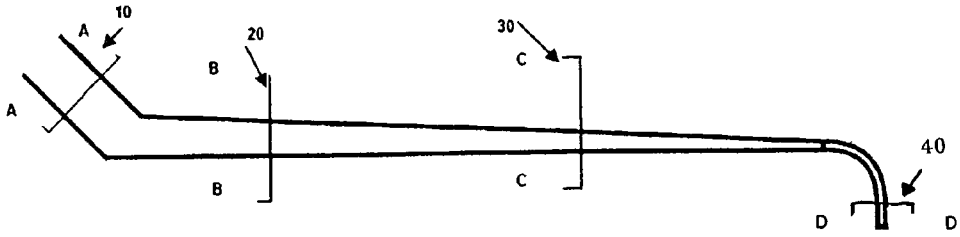
FIG. 1 illustrates the tapered cross sectional profile of the forming device or forming head showing its decreasing cross-sectional dimension to maintain constant the velocity and/or slightly accelerate the velocity of the fibers and air flows through the spreading section while maintaining laminar air flow and minimizing turbulence.

This invention simplifies what has been attempted before in a very elegant aerodynamic execution of a device which not only distributes the fibers uniformly in the cross machine direction, but also allows them to be formed into a web when injected onto a forming zone and can be expanded laterally to accommodate any width of the forming zone.

The key aerodynamic parameters for conveying solid particles or fibers in an air stream are well known and published in the art. The difficulty has been in developing a forming head that can maintain these conditions continuously and distribute fibers onto a forming zone at the uniformity levels and the forming zone widths desired.

A forming zone in most air laid machines is a foraminous screen supported over a vacuum box to consolidate the individual fibers into a web after the air is removed. Other types of forming zones are rotary vacuum drums or condensers into which the air is blown into and the fibers are condensed into a web on its surface later to be removed from the forming screen and transferred to another process operation. Other forming zones are composed by air conveying and injecting the individual cellulose fibers into a curtain of molten polymeric fibers as they are extruded from the die and later consolidated in a blended form onto a forming screen or secondary forming zone.

Fibers or particles, because they are denser and consequently heavier than air, tend to follow their own trajectories due to the iso-kinetic forces exhibited in the air stream. Therefore, it is imperative that air forming devices be designed to accommodate not only for the air characteristics required, but also accommodate the ability to uniformly convey and distribute particles or fibers in the cross direction, especially when a substrate or web is to be formed from the device and must exhibit uniformity of composition in the traverse direction.

Fibers, especially cellulose fluff fibers, need to be well defibrated into individual fibers and the conveying air well conditioned to prevent static and clumping. This process is well understood in the industry, with several successful designs currently in the market place. Companies like Kamas, M&J, and Framecannica have developed devices to defibrate pulp into individual fibers for many years now. The biggest use of these fibers is in absorbent cores for disposable products such as baby diapers and feminine care sanitary products. Fibers from such devices can then be conveyed by air to their final cellulose fiber forming zones.

In the case of forming absorbent batts in which the thickness or basis weight of the batt is large (greater than 100 gsm) the aerodynamic characteristics of the fluff forming devices are not as critical. The aerodynamic and design characteristics of the forming device become much more critical when the requirement is to form a substrate of less than 100 gsm and closer to the 20 gsm level. The challenge becomes on taking fibers that are being transported in a round duct at velocities that are typically in the 1000 to 10,000 fpm range and spreading these fibers to widths up to five meters wide while achieving a uniformity of the fibers or particles ranging under +/−10% by accepted standard test methods used in measuring this parameter.

The present invention uses sound engineering principles in achieving this goal. The critical parameter of this invention is to take fibers that are transported in a circular duct and spread them to widths of approximately 1.5 to 5.4 meters or greater uniformly.

FIG. 1 shows the forming head which accomplishes this goal. It is a funnel like device which is fed by a round transport duct, item 50 FIG. 2, which forms the inlet section. The inlet section transports a high concentration of fibers in its air stream.

Figure 2:
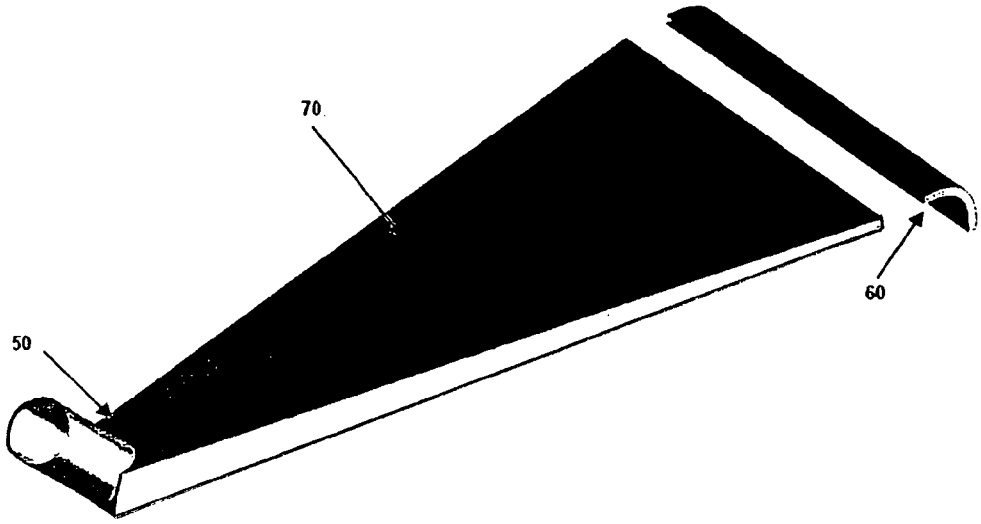
FIG. 2 illustrates a view of the forming head with its three primary components, the transport duct or fiber inlet section, the spreading section of the air and fiber flow and the outlet discharge section which is shown to be curved in this embodiment.

The spreading section of this forming head, item 70 FIG. 2, needs to provide air flows and fibers to the discharge section, item 60 FIG. 2, which are extremely uniform in the cross direction. This is accomplished by maintaining constant or slightly accelerating velocities through the funnel length with the minimum amount of turbulence, as the area of the round conveying duct is the same or slightly greater than the area of the rectangular discharge section at the end of the forming head. This concept of maintaining constant or slightly accelerating air velocities through any cross sectional plane such that AA=>BB=>CC=>DD as shown in FIG. 1 items 10, 20, 30, and 40 of the spreading section is critical in achieving uniform cross direction air profiles at the discharge of the unit.

Figure 4:
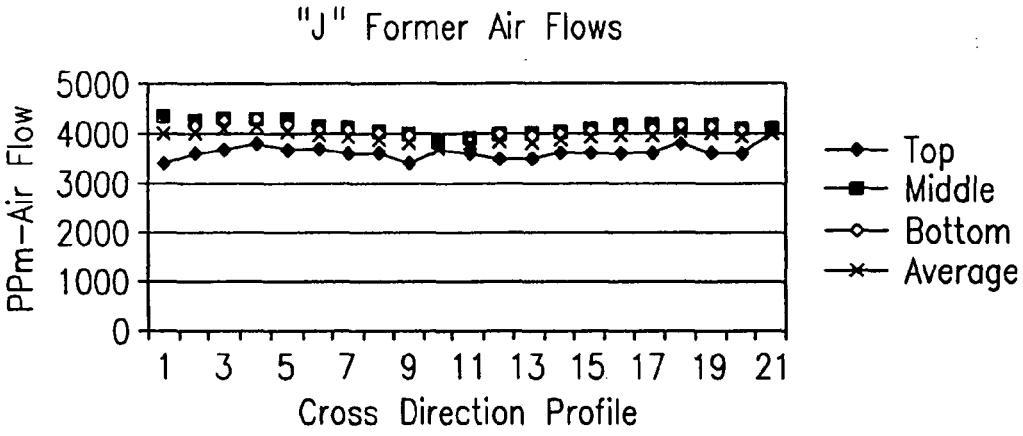
FIG. 4 illustrates the air flow profiles at the outlet of the discharge section.
Figure 5:
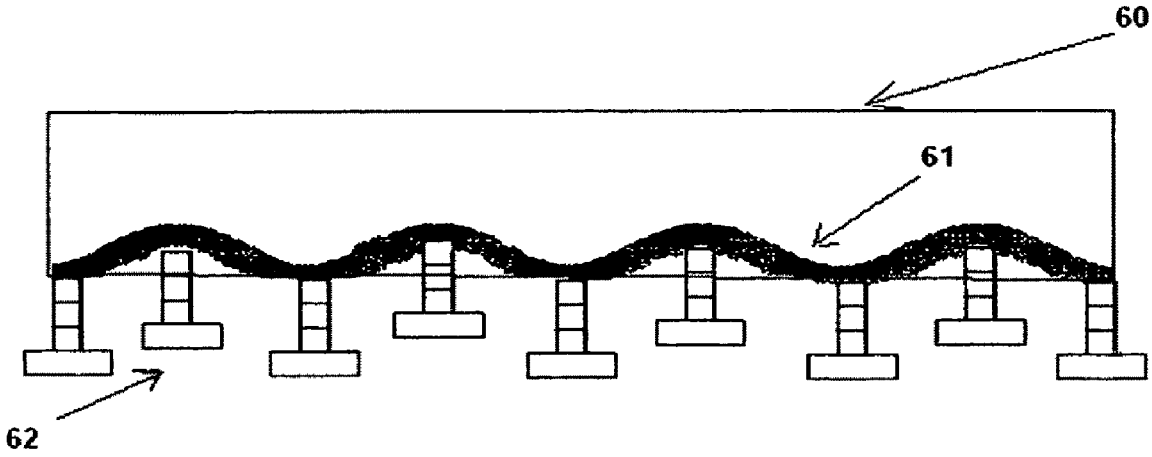
FIG. 5 illustrates the frontal cross-section of the discharge section with the adjustment plate and adjustment screws as a means to control the cross machine basis weight.

FIG. 4 shows the air profiles that are achieved applying these techniques to the forming head. This data was obtained from an unmodified discharge section profile. Meaning that the plate was flat and no adjustments to the adjusting screws were made. This air profile can be basically made totally flat when the profile control system shown in FIG. 5 is implemented by making the adjustments to the adjusting screws, item 62.

The second key parameter is to have the fiber velocities which are equivalent to the air velocities of the conveying air stream in the transport duct be dissipated so that the iso-kinetic energy of the fiber is greatly reduced as it enters the spreading section. This is accomplished by the geometry of item 50 of FIG. 2, which shows the round duct entering the funnel at an angle, thus having the fibers hit the far wall of the spreading section. In this manner the velocity of the fibers and the momentum of the fibers are dissipated. This allows the fibers then to be re-aligned with the airflow profiles in the spreading section that will be developed by the geometries and air velocities used in the design of this spreading section.

If this step is not done, the fibers would have the tendency to stay in the center of the spreading section creating a heavier center on the substrate formed. The angle of the circular duct to the spreading section can vary, as long as the fiber velocity is dissipated as they strike the back wall of the spreading section. The angle in which the circular duct enters the funnel will depend on the height to width ratio of the funnel itself such that this angle can vary from 15° to 90°, but will be closer to 45° in most typical applications. Other means of transporting the fibers to the entrance of the forming head such as venturi inlets can be contemplated so that the velocities of the individual fibers can align themselves with the velocities of the air stream.

Once the fibers are in the spreading section, it is important that they have enough residence time in this section to streamline themselves to the airflows that have been developed within the section. This is accomplished by having the height of the spreading section be at a minimum equivalent to ten times the diameter of the round transport duct for the fibers. Lengths much shorter than 10 equivalent diameters will result in less efficient fiber spreading in the cross direction and unacceptable profiles.

As there may be physical limitations to optimizing the spreading section to heights greater than 10 equivalent diameters or greater of the width of the inlet duct, the angle of the fiber inlet to the wall of the funnel will need to be adjusted accordingly to accommodate this relationship.

The third key element of this invention is the ability to control the discharge of the fibers onto a forming zone such as a foraminous forming screen or onto another fiber stream in order for the fibers to blend with these fibers forming a web and provide acceptable formation.

In this case the angle in which the fibers are directed onto either type forming zone is critical. This angle may require adjustment. Item 60 in FIG. 2 shows a device which is used as the discharge section for the spreading section to turn the fibers in the proper direction. The figure shows a nozzle with a 90° turn. This angle can be varied and can be whatever the final forming zone application requires it to be. Besides designing the discharge with a specific angle, a method that can be used to vary this angle is to tilt the spreading and forming head to that angle which will be required for proper web forming.

Figure 3:
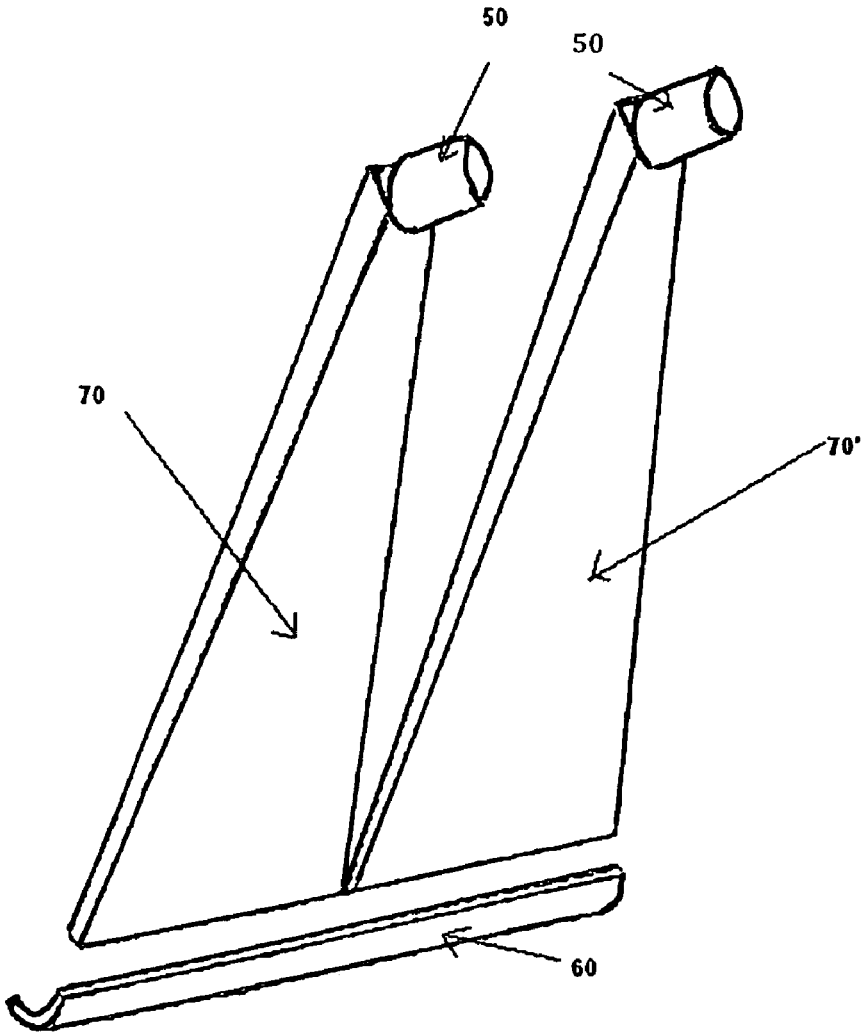
FIG. 3 illustrates a tandem construction of two fiber forming modules with the unitary and monolithic curved discharge section.

Another critical advantage that this system has is its ability to have modular forming units. Thus, these forming devices can be combined individually in the cross machine direction making the formation width of the machine to any width desired. FIG. 3 shows the advantage of this design by showing two side-to-side spreading sections items 70 and 70'. There is no limitation to the number of spreading sections with their respective inlet sections that can be added in the cross machine direction making it possible to achieve widths of five meters or more. For practical purposes, the ideal width of the individual forming heads are in the range of 1 to 1.5 meters.

Even though the spreading sections with their respective inlet sections are separate units, their discharge portion, item 60 in the figures shown, is a continuous, monolithic, unitary section. In this manner, the fibers are air formed with uniform cross direction when injected into the final forming zone without any separation as a result of combining the separate spreading sections through the unitary discharge section.

Furthermore, the discharge section as is shown in FIG. 5, item 60, has an adjustable bottom plate, item 61, which can be constricted in opening by adjustable screws, item 62, to influence the trajectory of both the fiber and air stream. This added control system controls for a uniform profile of fibers into the forming zone.

The plate material is made of a soft, flexible metal or plastic which bends as stress is applied via turning screws such as shown in item 62 illustrated in FIG. 5, in the cross-section of the discharge section of the forming head. The adjustment of the plate at this juncture is relatively small, thus creating restrictions to the discharge opening in the vicinity of 0.25 to 0.75 inches. These restrictions serve to accelerate the discharge air and as a result force the fibers to spread out in that particular location allowing for the basis weight to be adjusted. Adjustments made by this technique result in a correction of +/−3 grams per square meter to the final fibrous substrate being formed, and are used as a means to fine tune any irregularities to the basis weight profile.

The effect of the discharge section adjustment plate is optimized by the curvature of the full width monolithic discharge section item 60 FIG. 2. The curvature of this section tends to have the fibers in the airstream hug the bottom wall of the discharge section as a result of the iso-kinetic and centrifugal forces exhibited, thus making the fibers more susceptible to movement and redistribution in the airstream as a result of the adjustments made to the bottom discharge plate.

As the angle of the discharge can vary depending on the nature of the forming zone that the fibers are being injected into, the effectiveness of the control exhibited by varying the gap of the discharge outlet is impacted. Consequently, the control originally exhibited on a discharge outlet with a 90° outlet is reduced.

Figure 6:
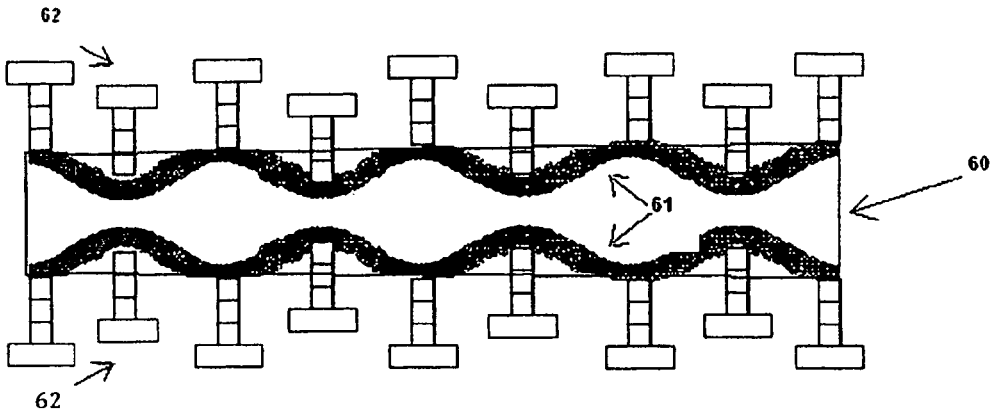
FIG. 6 illustrates the frontal cross section of the discharge section with a dual adjustment system as FIG. 5 both on top and bottom of the discharge section to add enhanced control to the cross machine basis weight profile prior to the injection of the fibers to the forming zone profile.

As the angle can be increased from 90° to 180°, the fibers would then become much better distributed through the entire cross-section of the discharge section rather than hug the bottom wall as they would with a 90° outlet angle. Consequently, a further improvement to this control device was developed, which would allow for the control of both fiber and air distribution by constricting the outlet of the discharge from both the top and the bottom walls of the discharge section as shown in FIG. 6. In this manner the velocities of the air stream could be further increased in certain regions in the cross direction, making the control of the adjustments as great as +/−5 gsm in the cross-direction of the web.

What is claimed:

1. A former head of the kind used for dry forming fibrous non-woven webs, where a fiber material mixed with air is conducted through a round transport duct, having a diameter, and uniformly expanded in the cross-direction through a spreading section and then passes through a discharge section onto a forming zone, comprising:

a) the fiber velocities at the entrance of said spreading section are dissipated to be less than those in said transport duct;

b) the geometry of said spreading section provides constant or slightly accelerating air and fiber velocities in said spreading section to those found in said transport duct;

c) the length of said spreading section is about ten times greater than said diameter of said transport duct; and d) a means for adjusting a gap in said discharge section which allows control of the cross-direction air and fiber flows to said forming zone by modifying the air and fiber velocities through variations of said gap by undulating a static plate.

2. A former head of the kind used for dry forming fibrous non-woven webs, where a fiber material mixed with air is conducted through a first transport duct and uniformly expanded in the cross-direction through a first spreading section and then passes through a first discharge section onto a first forming zone, comprising:

a) the fiber velocities at the entrance of said first spreading section are dissipated to be less than those in said first transport duct;

b) the geometry of said first spreading section provides constant or slightly accelerating air and fiber velocities in said first spreading section to those found in said first transport duct;

c) the length of said first spreading section is about ten times greater than the diameter of said first transport duct;

d) means for adjusting a gap in said first discharge section which allows control of the cross-direction air and fiber flows to said first forming zone by modifying the air and fiber velocities through variations of said gap by undulating a first static plate; and e) laterally positioning a second forming head adjacent to said forming head, said second forming head capable of conducting a fiber material mixed with air through a second transport duct and uniformly expanded in the cross-direction through a second spreading section and then passes through a second discharge section onto a second forming zone, said second discharge section having a gap which allows control of the cross-direction air and fiber flows to said second forming zone by modifying the air and fiber velocities through variations of said gap by undulating a second static plate.

3. The former head of claim 2 wherein the fiber velocities at the entrance of each of said first and second spreading sections are dissipated to be less than the fiber velocities in each of said first and second transport ducts.

4. The former head of claim 2 wherein the geometry of each of said first and second spreading sections provides constant or slightly accelerated air and fiber velocities in each of said first and second spreading sections to those found in each of said first and second transport ducts.

5. The former head of claim 2 wherein the length of each of said first and second spreading sections is about ten times greater than the diameter of each of said first and second transport ducts.

6. The former head of claim 2 further comprising means for adjusting said gap in said second discharge section to control the cross-direction air and fiber flows to said second forming zone by modifying the air and fiber velocities through undulations of a said second static plate.

7. The former head of claim 2 wherein said first and second discharge sections form a continuous, monolithic unitary section.

8. The former head of claim 1 wherein said fibrous non-woven web has a basis weight of less than 100 grams per meter.

9. The former head of claim 1 wherein said fibrous non-woven web has a basis weight of between 20 gsm and 100 gsm.

10. The former head of claim 1 wherein said fiber material conducted through said transport duct has a velocity of between 1,000 feet per minute and 10,000 feet per minute.

11. The former head of claim 1 wherein said fiber velocity is equivalent to said air velocity in said transport duct and said fiber and air velocities dissipate in said spreading section thereby reducing the iso-kinetic energy of said fibers.

12. The former head of claim 11 wherein said transport duct is a round duct which enters said spreading section at an angle.

13. The former head of claim 12 wherein said angle is from between 15° and 95°.

14. The former head of claim 13 wherein said angle is 45°.

15. The former head of claim 1 wherein said discharge section is aligned at 90° to said forming zone.

16. The former head of claim 2 wherein said forming head and said first forming head are modular units.

17. The former head of claim 1 wherein said forming head has a width ranging between 1 meter and 1.5 meters.

18. The former head of claim 1 wherein said static plate can be undulated by a plurality of adjusting screws.

19. The former head of claim 1 wherein said static plate is constructed of a soft, flexible metal or plastic.

20. A former head of the kind used for dry forming fibrous non-woven webs, where a fiber material mixed with air is conducted through a round transport duct, having a diameter, and uniformly expanded in the cross-direction through a spreading section and then passes through a discharge section onto a forming zone, comprising:

a) the fiber velocities at the entrance of said spreading section are dissipated to be less than those in said transport duct;

b) the geometry of said spreading section provides constant or slightly accelerating air and fiber velocities in said spreading section to those found in said transport duct;

c) the length of said spreading section is about ten times greater than said diameter of said transport duct; and d) means for adjusting a gap in said discharge section which allows control of the cross-direction air and fiber flows to said forming zone by modifying the air and fiber velocities through variations of said gap by undulating a static plate, said static plate capable of creating restrictions in said gap of between 0.25 inches to 0.75 inches.

* * * * *